US009856813B2

(12) United States Patent
Dian

(10) Patent No.: US 9,856,813 B2
(45) Date of Patent: Jan. 2, 2018

(54) METHOD FOR DETERMINING THE VALVE OPENING MOMENT IN PIEZO SERVO-DRIVEN INJECTORS

(71) Applicant: Continental Automotive GmbH, Hannover (DE)

(72) Inventor: Vincent Dian, Manching (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 30 days.

(21) Appl. No.: 15/038,563

(22) PCT Filed: Sep. 30, 2014

(86) PCT No.: PCT/EP2014/070990
§ 371 (c)(1),
(2) Date: May 23, 2016

(87) PCT Pub. No.: WO2015/074794
PCT Pub. Date: May 28, 2015

(65) Prior Publication Data

US 2016/0298562 A1 Oct. 13, 2016

(30) Foreign Application Priority Data

Nov. 21, 2013 (DE) ..... 10 2013 223 750

(51) Int. Cl.
*F02M 51/06* (2006.01)
*F02D 41/20* (2006.01)
(Continued)

(52) U.S. Cl.
CPC ..... *F02D 41/2096* (2013.01); *F02D 41/2467* (2013.01); *F02M 51/0603* (2013.01);
(Continued)

(58) Field of Classification Search
CPC ..... F02D 41/2096; F02D 2041/2055; F02D 2200/0618; F02M 51/0603; F02M 51/0607; F02M 63/0026
(Continued)

(56) References Cited

U.S. PATENT DOCUMENTS 7,040,297 B2 5/2006 Baranowski et al. ..... 123/498
7,815,128 B2 10/2010 Beilharz et al. ..... 239/5
(Continued)

FOREIGN PATENT DOCUMENTS

DE 10143501 C1 5/2003 ..... F02D 41/20
DE 10301822 A1 7/2004 ..... F02D 41/20
(Continued)

OTHER PUBLICATIONS

German Office Action, Application No. 102013223750.2, 4 pages, dated May 21, 2014.
(Continued)

*Primary Examiner* — Erick Solis
(74) *Attorney, Agent, or Firm* — Slayden Grubert Beard PLLC

(57) ABSTRACT

A method for determining the opening for piezo servo-driven injectors may include measuring a voltage and a charge at an end of a charging process of the piezo actuator; determining a provisional scaling factor by calculating Q/U; determining the maximum of $C_{VORL}$ and using the instant at which the maximum occurs as an approximation value of the valve opening instant; measuring the charge and voltage at the approximation of the valve opening instant; solving the equation:

$$1.25 \times F^2/E \times C = (U \times C - Q)^2$$

Where F=force acting on the piezo actuator, E=electrical parameter of the piezo actuator; determining a new scaling factor from the solution of the equation; calculating the
(Continued)

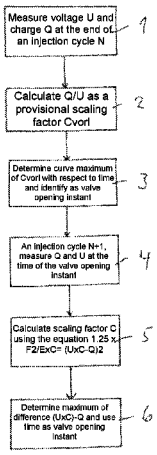

difference (U×C−Q) and determining a maximum of said value; and using the instant at which said maximum occurs as valve opening instant.

5 Claims, 1 Drawing Sheet

(51) Int. Cl.
*F02M 63/00* (2006.01)
*F02D 41/24* (2006.01)

(52) U.S. Cl.
CPC . *F02M 63/0026* (2013.01); *F02D 2041/2055* (2013.01); *F02D 2200/0618* (2013.01)

(58) Field of Classification Search
USPC ..... 123/472
See application file for complete search history.

(56) References Cited

U.S. PATENT DOCUMENTS

| | | | | |
|---|---|---|---|---|
| 8,714,140 | B2 | 5/2014 | Borchsenius | 123/494 |
| 8,973,893 | B2 | 3/2015 | Lehner et al. | 251/129.06 |
| 2008/0028843 | A1 | 2/2008 | Dietl et al. | 73/114.45 |
| 2009/0090333 | A1* | 4/2009 | Spadafora | F02D 41/2096 123/494 |
| 2010/0275885 | A1* | 11/2010 | Becker | F02D 41/2096 123/478 |
| 2013/0133748 | A1* | 5/2013 | Lehner | F02D 41/247 137/1 |
| 2014/0007665 | A1* | 1/2014 | Katzenberger | F02D 41/2096 73/114.48 |
| 2015/0013647 | A1 | 1/2015 | Zhang et al. | 123/478 |
| 2016/0053704 | A1* | 2/2016 | Russe | F02D 41/2096 123/478 |

FOREIGN PATENT DOCUMENTS

| | | | | |
|---|---|---|---|---|
| DE | 102005040533 | A1 | 3/2007 | F02D 41/20 |
| DE | 102006036568 | A1 | 2/2008 | F02D 41/20 |
| DE | 102006048979 | A1 | 4/2008 | F02D 41/20 |
| DE | 102008023373 | A1 | 11/2009 | F02D 41/20 |
| DE | 102010021169 | A1 | 11/2011 | F02D 41/00 |
| DE | 102012204272 | A1 | 9/2013 | F02D 41/20 |
| GB | 2490531 | * | 7/2012 | F02D 41/20 |
| GB | 2490531 | A | 11/2012 | F02D 41/20 |
| WO | 2015/074794 | A1 | 5/2015 | F02D 41/20 |

OTHER PUBLICATIONS

International Search Report and Written Opinion, Application No. PCT/EP2014/070990, 18 pages, dated Jan. 16, 2015.

* cited by examiner

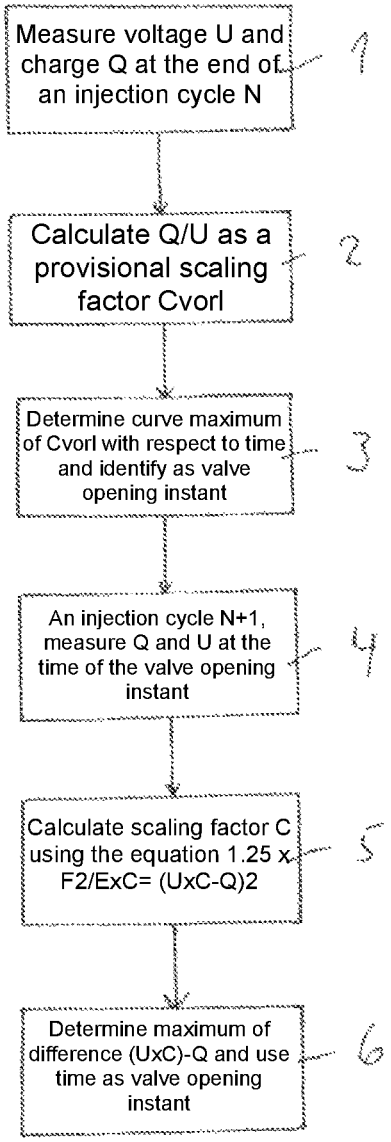
Measure voltage U and charge Q at the end of an injection cycle N
1
Calculate Q/U as a provisional scaling factor Cvorl
2
Determine curve maximum of Cvorl with respect to time and identify as valve opening instant
3
An injection cycle N+1, measure Q and U at the time of the valve opening instant
4
Calculate scaling factor C using the equation 1.25 x F2/ExC= (UxC-Q)2
5
Determine maximum of difference (UxC)-Q and use time as valve opening instant
6

METHOD FOR DETERMINING THE VALVE OPENING MOMENT IN PIEZO SERVO-DRIVEN INJECTORS

CROSS-REFERENCE TO RELATED APPLICATIONS

This application is a U.S. National Stage Application of International Application No. PCT/EP2014/070990 filed Sep. 30, 2014, which designates the United States of America, and claims priority to DE Application No. 10 2013 223 750.2 filed Nov. 21, 2013, the contents of which are hereby incorporated by reference in their entirety.

TECHNICAL FIELD

The present disclosure relates to piezoelectronic actuators and, more specifically, a method for determining the valve opening instant in piezo servo-driven injectors, in which the piezo actuator is used as a sensor element.

BACKGROUND

Various methods are known in which the piezo actuator is used as a sensor element in order to determine the valve opening instant of a piezo servo-driven injector or in order to measure the idle travel that must be taken into consideration in order to implement precise control of the injection quantity.

In these methods, the capacitance curve of the piezo actuator is analyzed, wherein the valve opening instant is related to the maximum of the capacitance curve. Said method, however, does not deliver precise results in all situations under all conditions.

In the case of a standard piezo servo-driven injector, a valve is actuated counter to the prevailing hydraulic pressure. For safety reasons, the piezo actuator is installed with a predefined play, which yields a predefined idle travel. Said idle travel is dependent on various parameters such as for example the piezo polarization, the actuator temperature, the number of injection processes, the engine speed, but in any case also on the wear of the various valve parts. Owing to these parameters, it is difficult to keep the idle travel in a small tolerance range under all operating conditions. Since the idle travel is of significant importance with regard to the injector function, it is important to measure said idle travel and compensate its effect. For this purpose, the above-described measurement of the valve opening instant is of importance.

For the idle travel measurement, an indirect measurement concept exists. Here, the piezo actuator is actuated and the leakage generated by the valve is measured. Owing to the large dynamic variation of the idle travel, it is of crucial importance here for the idle travel to be measured as often as possible. This however leads to undesired leakage.

SUMMARY

A method for determining the valve opening instant in piezo servo-driven injectors, may be used for example for the above-described idle travel determination and idle travel control. Some embodiments of the present teaching may provide a method of the type described in the introduction which can be implemented particularly easily and makes it possible to obtain an "online" value.

A method of the stated type may comprise the following steps:

measuring the voltage U and charge Q at the end of a charging process of the piezo actuator;

determining a provisional scaling factor $C_{VORL}$ by calculating Q/U;

determining the curve maximum of $C_{VORL}$ with respect to time and using the instant at which the maximum occurs as an approximation value of the valve opening instant;

measuring the charge Q and voltage U at the instant of the determined approximation value of the valve opening instant;

solving the equation $1.25\times F^2/E\times C=(U\times C-Q)^2$ (F=force acting on the piezo actuator, E=electrical parameter of the piezo actuator)

and determining a new scaling factor C therefrom;

calculating the difference $(U\times C-Q)$ and determining a maximum of said value; and using the instant at which said maximum occurs as valve opening instant.

BRIEF DESCRIPTION OF THE DRAWING

The disclosure will offer detail below on the basis of an exemplary embodiment in conjunction with the drawing.

FIG. 1 shows a flow diagram schematically illustrating the individual steps of the method according to the teachings of the present disclosure.

DETAILED DESCRIPTION

In some embodiments, the piezo actuator is used as a sensor, and using this, it is detected when the valve opens. This is performed not on the basis of a piezo capacitance analysis but on the basis of a linear model which precisely describes the piezo characteristic.

In some embodiments, two parameters are measured, specifically the voltage U and the charge Q. To compare these two parameters, a scaling factor is required. Said scaling factor has the units of μF, and can therefore be referred to, for example, as a theoretical piezo capacitance. The scaling factor is normally unknown and is, by way of the method according to the invention, determined in approximated fashion in two steps.

In a first step, the voltage U and charge Q measured at the end of a charging process of the piezo actuator are used to determine the value Q/U, which is used as a provisional scaling factor $C_{VORL}$. The curve maximum of $C_{VORL}$ with respect to time is determined, and the instant at which the maximum occurs is used as an approximation value of the valve opening instant. With this first step, therefore, a first estimation of the valve opening instant is performed.

In a second step, the charge Q and the voltage U are measured at the instant of the determined approximation value of the valve opening instant. Then, the equation $1.25\times F^2/E\times C=(U\times C-Q)^2$ is solved, wherein the measured values U and Q are used here. The factors F (force) and E (electrical parameter) are known, such that only C remains unknown. It is therefore possible for an updated value of C to be determined. Said new value of C is used for the calculation of the difference $(U\times C-Q)$, and a maximum of said value is determined. The instant at which said maximum occurs is used as valve opening instant.

The abovementioned factor $1.25\times F^2/E$ is preferably obtained from the rail pressure measurement. If the corresponding value is not already available, it is therefore necessary, for the method according to the invention, for a corresponding rail pressure measurement to also be performed.

The method steps described above may not all be performed upon every injection process. Rather, in particular, an approach is followed in which the provisional scaling factor $C_{VORL}$ is determined in a preceding injection cycle and is used in a subsequent injection cycle for the determination of the valve opening instant. Therefore, for the injection cycle N+1, use is preferably made of the scaling factor $C_{VORL}$ determined in approximated fashion in the preceding cycle N.

For example, at the end of the cycle N, the voltage and charge measurements are performed. On the basis of these, the scaling factor $C_{VORL}$ is determined in approximated fashion. Using the scaling factor $C_{VORL}$ determined in the cycle N, the value (U×C−Q) is determined in the subsequent cycle N+1, and from this, the maximum is determined, which corresponds to the valve opening instant.

The method illustrated here serves for the determination of the valve opening instant in a piezo servo-driven injector of a motor vehicle, in which method the piezo actuator is used as a sensor element. The valve opening instant obtained may be used for example for the determination and control of the idle travel of the injector.

Such piezo servo-driven injectors are known and therefore need not be discussed in any more detail at this juncture. During the charging process of a piezo actuator of said type, the method according to the invention is carried out as an "online" method, wherein, in a first injection cycle N, the voltage U and charge Q are measured at the end of said cycle. This is denoted by step 1 in FIG. 1.

In step 2, from the measured voltage and charge values, a provisional scaling factor $C_{VORL}$ is determined by calculating Q/U.

In the subsequent step 3, the curve maximum of $C_{VORL}$ with respect to time is determined. The corresponding instant at which the maximum occurs is used as an approximation value of the valve opening instant.

Then, in a subsequent injection cycle N+1, the voltage U and the charge Q are in turn measured, specifically now at the instant of the determined approximation value of the valve opening instant. This is denoted by step 4. In step 5, a new scaling factor C is determined from the equation $1.25\times F^2/E\times C=(U\times C-Q)^2$. U and Q have been measured. The factor $1.25\times F^2/E$ is obtained from a rail pressure measurement that is carried out, and is therefore known.

In step 6, the difference (U×C−Q) is calculated, and a maximum of said value is determined. The instant at which said maximum occurs is used as valve opening instant.

What is claimed is:

1. A method for determining the valve opening instant in piezo servo-driven injectors, the method comprising the following steps:

measuring a voltage U and a charge Q at an end of a charging process of the piezo actuator;

determining a provisional scaling factor $C_{VORL}$ by calculating Q/U;

determining the curve maximum of $C_{VORL}$ with respect to time and using the instant at which the maximum occurs as an approximation value of the valve opening instant;

measuring the charge Q and voltage U at the instant of the determined approximation value of the valve opening instant;

solving the equation $$1.25\times F^2/E\times C=(U\times C-Q)^2$$

(F=force acting on the piezo actuator, E=electrical parameter of the piezo actuator);

determining a new scaling factor C from the solution of the equation;

calculating the difference (U×C−Q) and determining a maximum of said value; and using the instant at which said maximum occurs as valve opening instant.

2. The method as claimed in claim 1, wherein the factor $1.25\times F^2/E$ is obtained from the rail pressure measurement.

3. The method as claimed in claim 1, wherein the provisional scaling factor $C_{VORL}$ is determined in a preceding injection cycle N and is used in a subsequent injection cycle N+1 for the determination of the valve opening instant.

4. The method as claimed in claim 1, further comprising:

calculating the idle travel based at least in part on the valve opening instant; and adjusting an injection quantity of the injectors based on the calculated idle travel.

5. A method for controlling the injection of fuel into a combustion chamber of an internal combustion engine, the method comprising:

measuring a voltage U and a charge Q at the end of a charging process of a piezo actuator associated with the combustion chamber;

determining a provisional scaling factor $C_{VORL}$ by calculating Q/U;

determining a curve maximum of $C_{VORL}$ with respect to time and using an instant at which the maximum occurs as an approximation value of the valve opening instant;

measuring the charge Q and voltage U at the instant of the determined approximation value of the valve opening instant;

solving the equation $$1.25\times F^2/E\times C=(U\times C-Q)^2$$

(F=force acting on the piezo actuator, E=electrical parameter of the piezo actuator);

determining a new scaling factor C from the solution of the equation;

calculating the difference (U×C−Q) and determining a maximum of said value;

using the instant at which said maximum occurs as valve opening instant;

calculating the idle travel based at least in part on the valve opening instant; and adjusting a control signal of the injector based on the calculated idle travel.

* * * * *